US006743124B2

(12) United States Patent
Tsunoda et al.

(10) Patent No.: US 6,743,124 B2
(45) Date of Patent: Jun. 1, 2004

(54) GOLF BALL

(75) Inventors: Masaya Tsunoda, Kobe (JP); Masahide Onuki, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/078,390

(22) Filed: Feb. 21, 2002

(65) Prior Publication Data

US 2002/0183135 A1 Dec. 5, 2002

(30) Foreign Application Priority Data

Mar. 8, 2001 (JP) ..... 2001-064525

(51) Int. Cl.[7] ..... A63B 37/04; A63B 37/06; A63B 37/00

(52) U.S. Cl. ..... 473/377; 473/371; 473/351

(58) Field of Search ..... 473/351–378

(56) References Cited

U.S. PATENT DOCUMENTS 4,928,965 A * 5/1990 Yamaguchi et al. ..... 473/332
5,368,304 A 11/1994 Sullivan et al.
6,123,629 A * 9/2000 Yamaguchi et al. ..... 473/372

* cited by examiner

*Primary Examiner*—Gregory Vidovich
*Assistant Examiner*—Alvin A. Hunter, Jr.
(74) *Attorney, Agent, or Firm*—Birch, Stewart, Kolasch & Birch, LLP

(57) ABSTRACT

There is provided a golf ball with a low spin rate, a high launch angle and an increased flight distance, characterized in a ratio of a primary natural frequency of the golf ball in a direction in which the ball deforms (in a longitudinal direction) (fn) and a primary natural frequency of the ball in a vibration mode in a direction of torsion, i.e., a ratio fc/fn provided in a range: $2.22 \leqq (fc/fn) \leqq 2.45$. This relationship is satisfied by a golf ball for example having a core formed of a plurality of layers and having a center smaller in complex modulus than the core's outermost layer or having a cover with a complex modulus adjusted to have a large value.

5 Claims, 7 Drawing Sheets

GOLF BALL

BACKGROUND OF THE INVENTION

1. Field of the Invention

The present invention relates golf balls providing low spin rates and high launch angles to achieve increased ball flight distances.

2. Description of the Background Art

For golf balls, spin rate is an important factor having a significant influence on their flight performance and controllability. If a golf ball has a high spin rate, backspin allows the ball on the green to stop rapidly, and the ball can also be side spin and thus controlled so that its flight trajectory can draw or fade. As they are superior in controllability, golf balls of high spin rates are preferred by professional golfers and golfers with small handicaps.

A golf ball of a high spin rate, however, is not suitable for beginners or golfers with large handicaps, who cannot control the ball's spin rate skillfully. When such a golfer hits a golf ball with a golf club the golfer unintentionally imparts sidespin to the ball. The ball is thus sliced or hooked and fails to fly in a direction as intended and also provides a reduced ball flight distance. As such, golfers with large handicaps prefer golf balls of low spin rates as such balls less slice and hook and thus provide large flight distances.

From the above view point, U.S. Pat. No. 5,368,304 discloses a technique related to a golf ball of a low spin rate. This technique provides a golf ball including a core having a Reihle compression of at least 0.076 and a cover having a Shore D hardness of at least 65. More specifically, the core can be relatively soft while the cover can be relatively hard to provide the golf ball with a low spin rate.

Conventional techniques employed to adjust spin rates are determined by the profile in rigidity of the entire golf ball, the magnitude in rigidity of the ball's outermost layer, the thickness of the outermost layer, the profile in specific gravity of the entire ball, and many other factors combined organically. As such, a spin rate insufficiently reduces, or even if it does sufficiently, another factor having a significant influence on flight distance, or a launch angle, lowers and as a result flight performance insufficiently improves.

SUMMARY OF THE INVENTION

The present invention contemplates a golf ball further lower in spin rate than conventional golf balls of low spin rates and higher in launch angle to alleviate slice and hook and also further increase ball flight distances to be suitable for golfers having large handicaps. The present invention is based on a finding that relatively optimizing a dynamic rigidity provided in a direction of impact deform in a longitudinal direction and that provided in a direction in which the ball has torsion, can provide the ball with a low spin rate and a high launch angle.

The present invention is a golf ball providing a ratio of a primary natural frequency provided in a direction in which the ball deforms (in a longitudinal direction) (fn) and a primary natural frequency provided in a vibration mode in a direction of torsion (fc), i.e., a ratio (fc/fn) in a range:

$$2.22 \leqq fc/fn \leqq 2.45.$$

Herein, value (fc/fn) is preferably 2.26 to 2.42, more preferably 2.28 to 2.35.

To adjust value (fc/fn) to fall within the above range, the golf ball can include a solid core and a cover, the solid core being formed of a plurality of layers and having a center smaller in complex modulus than the core's outermost layer.

In particular the solid core can effectively be formed of a plurality of layers having a complex modulus smallest at the center layer, larger at the outer layer(s) and largest at the outermost layer to achieve value (fc/fn) in the above range. Suitably the cover is greater in complex modulus than the core adjacent thereto.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention provides a ratio between a primary natural frequency in a direction of longitudinal flexure (fn) and that in a vibration mode in a direction of torsion (fc), i.e., a (fc/fn) of no less than 2.22 and no more than 2.45. When a golf ball is hit with a golf club it has torsion on a surface thereof contacting the club. For this torsion it is crucial how a tangential contact force while the ball is in contact with the club acts on the initial condition of the ball's spin rate and launch.

Figure 1A:
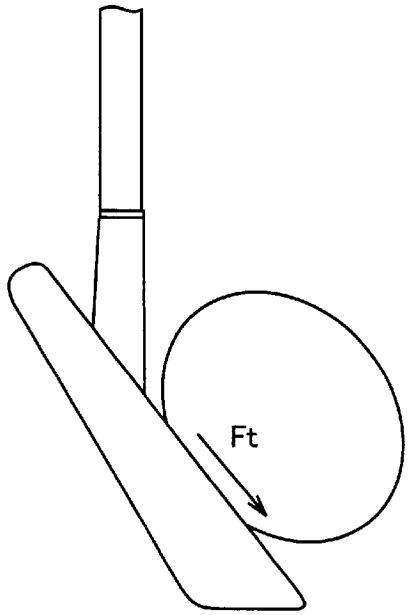
FIG. 1A is a schematic side view of a golf ball hit with a club.
Figure 1B:
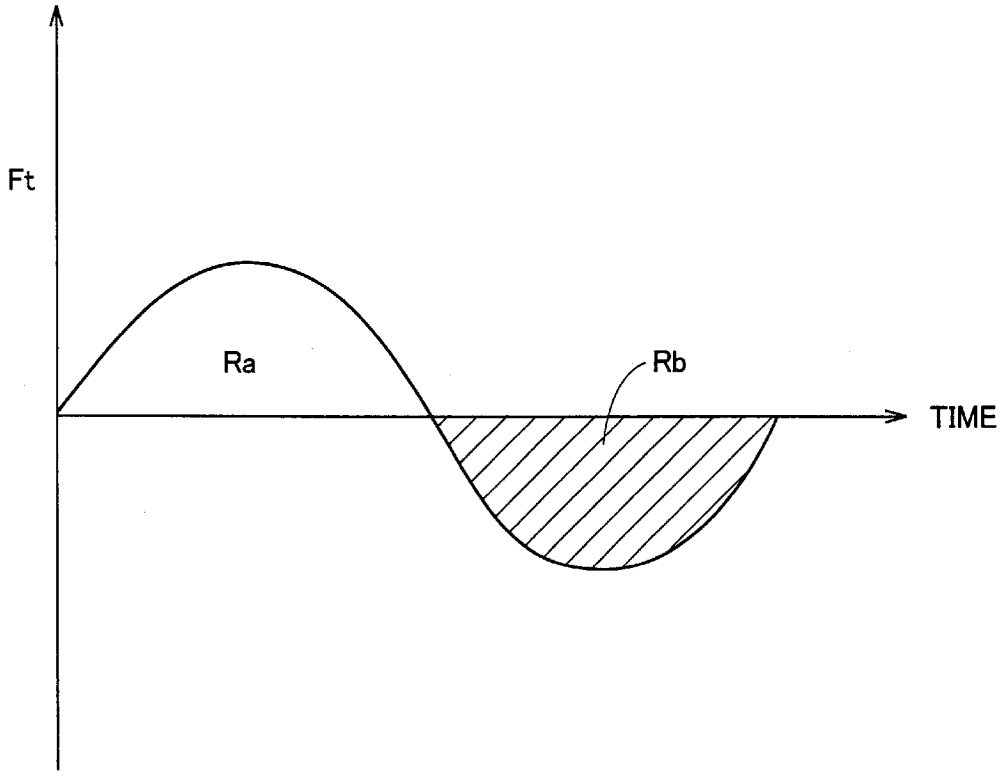
FIG. 1B is a graph of a contact force exerted when the ball is hit with the club versus time.

FIGS. 1A and 1B schematically show a golf ball in contact with a golf club at impact. As shown in FIG. 1, a tangential contact force (ft) acts in the direction of the arrow, and when rigidity in a direction of torsion is increased (as a result fc is increased), at an early timing during the contact the ball reverses and rotates in the opposite direction and an impulse acting on the topspin side increases and the ball's backspin rate reduces. More specifically, Ft and time has a relationship, as shown in FIG. 1B, and the hatched area (Rb) indicates an impulse of Ft on the topspin side and larger areas Rb provide smaller backspin rates.

Reducing a backspin rate depends on how large a magnitude of force is exerted on the topspin side while the golf ball is in contact with a golf club. To achieve this, contact time needs to be increased, and rigidity in a direction of torsion (or fc) needs to be increased. If a golf ball has a core rigidity smallest at the center and increasing uniformly and larger at the outer layer(s) it increases in rigidity in the direction of torsion, although it also increases in rigidity in a direction of deformation at impact (i.e., a longitudinal direction) (and fn also increases) and the ball also contacts the club for a reduced period of time and thus cannot have an effectively reduced backspin rate. The present invention is based on a finding that relatively optimizing a dynamic rigidity provided in a direction of impact deform (in a longitudinal direction) and that provided in a direction in which the ball has torsion, can provide the ball with a low spin rate and a high launch angle.

In the present invention the former adopts a primary natural frequency in a direction of longitudinal flexure (fn) as a physical constant and the latter adopts a primary natural frequency in a vibration mode in a direction of torsion (fc) as a physical constant. Primary natural frequency (fn) is measured in a procedure, as will hereinafter be described with reference to FIG. 2.

(1) Grind a golf ball G to be flat, circular, and 10 mm in diameter, and fix the ground portion with instant adhesive to a vibrator 17 on an attachment 17*a* at a support 17*b;*

(2) Attach an acceleration pickup 19 under attachment 17*a;*

(3) Operate vibrator 17 to vibrate golf ball G to measure vibration rate V of the golf ball via a reflective tape 2 by means of a laser radiation unit 1, a manipulator 12 and a laser Doppler velocimeter 11. This utilizes a principle of a known laser Doppler vibrometer. Note that the reflective tape is a Scotch light reflection tape of SUMITOMO 3M Limited and approximately 5 mm by 5 mm of the tape was stuck on the ball to have a reflective surface thereof facing the laser radiation;

(4) Transmit a voltage signal from acceleration pickup 19 to a power amplifier 15 which in turn amplifies the signal which is in turn taken into an FFT analyzer 13. Meanwhile, take the measured rate V from laser Doppler velocimeter 11 into FFT analyzer 13;

(5) Calculate a frequency transfer function G(s) from an acceleration A measured by FFT analyzer 13 and rate V, according to the following expression:

$G(s)$=Fourier transform of output rate V/Fourier transform of input acceleration $A$; and (6) from frequency transfer function G(s), read as a frequency having a maximal value the highest peak value of peaks indicated for a range in frequency of 400 to 4000 Hz. Note that in FIG. 2, a vibrator amplifier 16 controls the vibrator 17 vibration amplitude and has a function amplifying a voltage signal output from FFT analyzer 13.

Figure 3:
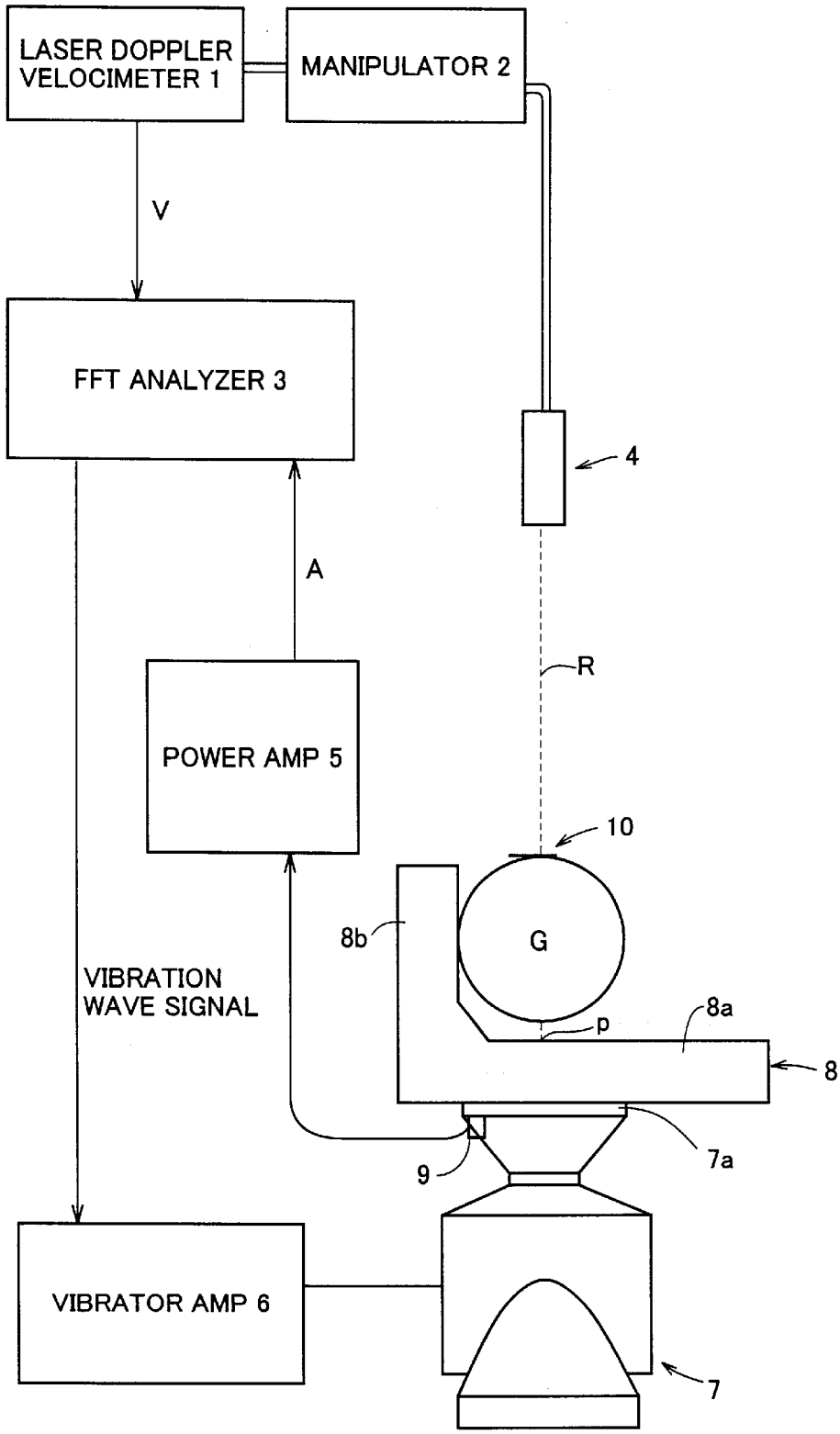
FIG. 3 schematically shows an apparatus employed to measure fc.

Primary natural frequency (fc) is measured in a manner, as described hereinafter with reference to FIG. 3.

(a) Arrange golf ball G on attachment 7*a* via a ball fixing jig 8. Fix the ball to jig 8 at a flange 8*b*, separate from the jig's base 8*a*. To fix golf ball G to flange 8*b*, grind the ball to be flat, circular, and 10 mm in diameter and apply instant adhesive on the ground portion and thus fix the ball to flange 8*b*. Position the ball such that an extension of a laser beam R passing through the ball reaches base 8*a* at a point P.

Figure 4A:
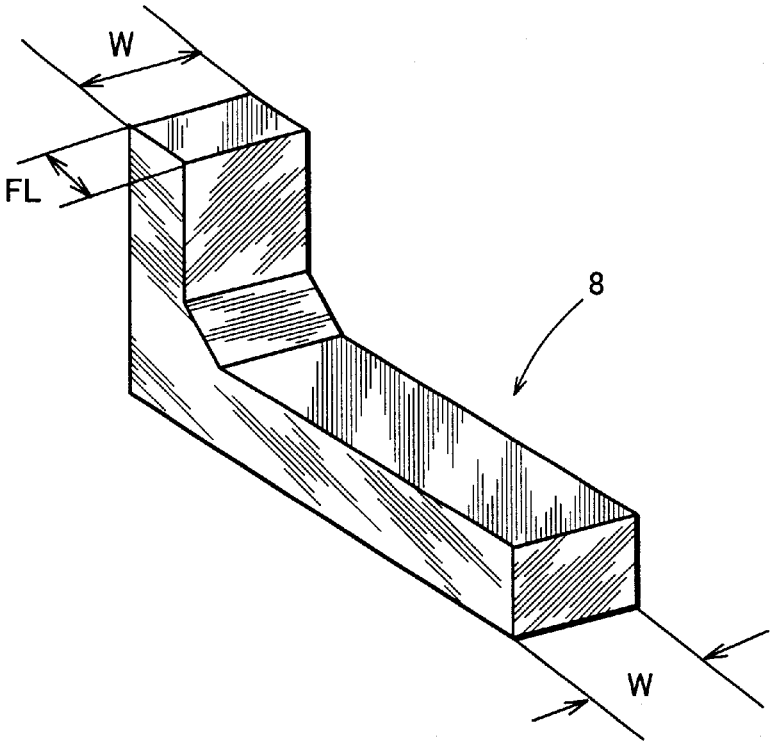
FIG. 4A is a perspective view of a jig used to fix a ball.
Figure 4B:
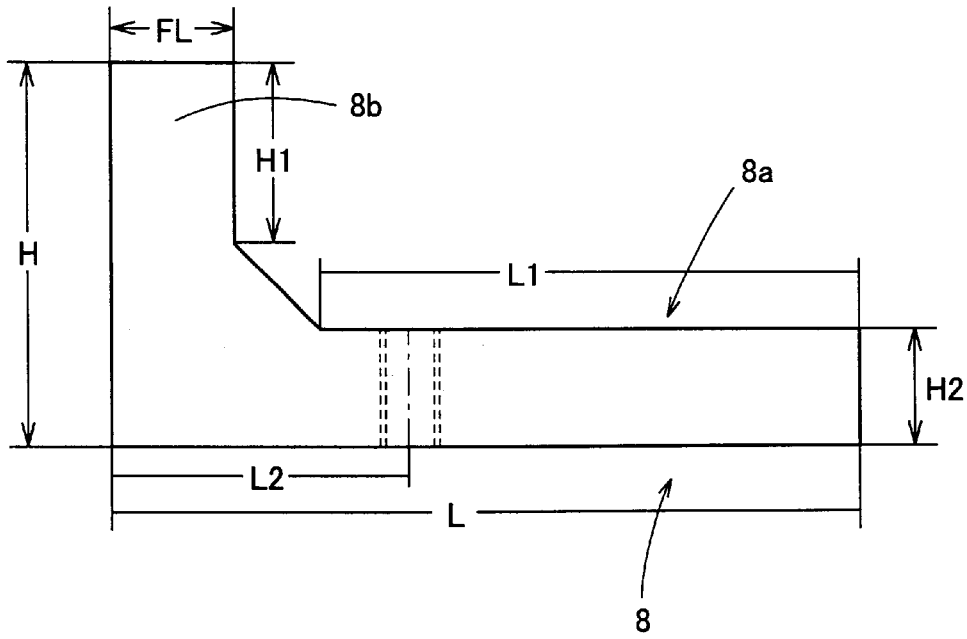
FIG. 4B is a side view thereof.

Herein, ball fixing jig 8 is formed of a material and have dimensions, as follows: Ball fixing jig 8 is formed of stainless steel (SUS) and weighs 379.5 g, and, in a perspective view, as shown FIG. 4A, and in a side view, as shown in FIG. 4B, it is formed of vertical flange 8*b* and base 8*a*. Each portion has dimensions, as follows:

Base

L: 93.9 mm

L1: 68.9 mm

L2: 36.37 mm

W: 25 mm

H: 2.15 mm

Vertical Flange

H: 47.35 mm

H1: 22.35

FL: 15 mm (b) Attach acceleration pickup 9 under attachment 7*a;*

(c) Operate vibrator 7 to vibrate golf ball G to measure vibration rate V of the golf ball via a reflective tape 10 by means of a laser radiation unit 4, a manipulator 2 and a laser Doppler velocimeter 1. This utilizes a principle of a known laser Doppler vibrometer. Note that the reflective tape is a Scotch light reflection tape of SUMITOMO 3M Limited and approximately 5 mm by 5 mm of the tape was stuck on the ball to have a reflective surface thereof facing the laser radiation;

(d) Transmit a voltage signal from acceleration pickup 9 to a power amplifier 5 which in turn amplifies the signal which is in turn taken into an FFT analyzer 3. Meanwhile, take the measured rate V from laser Doppler velocimeter 1 into FFT analyzer 3; and (e) Calculate a frequency transfer function G'(s) from an acceleration A measured by the FFT analyzer and rate V, according to the following expression:

$G'(s)$=Fourier transform of output rate $V'$/Fourier transform of input acceleration A'.

Herein from the above frequency transfer function the highest peak value of peaks indicated for a range in frequency of 400 to 4000 Hz is read as a frequency having a maximal value. Frequencies fn and fc were measured with equipment, as described in Table 1.

TABLE 1

Equipment used to measure fn, fc

| equipment | manufacturer & type |
|---|---|
| laser velocimeter | DANTEC Co., Ltd.<br>TRACKER MAIN UNIT TYPE55 N21 |
| manipulator | DANTEC Co., Ltd.<br>60X24 |
| FFT analyzer | HEWLETT PACKARD COMPANY<br>DYNAMIC SIGNAL ANALYZER 3562A |
| power amp | PCB PIEZOTRONICS Inc.<br>MODEL 482A18 |
| vibrator amp | SHINNIPPON SOKKI<br>POWER AMPLIFIER TYPE 360-B |
| vibrator | SHINNIPPON SOKKI<br>513-A |
| acceleration pickup | PCB PIEZOTRONICS Inc.<br>MODEL 352B22 |

A conventional golf ball has a value (fc/fn) falling within a range of 2.00 to 2.20. The present invention provides a value (fc/fn) of 2.22 to 2.45. In the present invention a golf ball can have a structure, and its solid core can have a structure and be formed of a material having a complex modulus and its cover can have a structure, be formed of a material having a complex modulus and have a thickness, as adjusted to allow value (fc/fn) to be set to fall within a predetermined range, for example in the following method:

(1) Increase the solid core in complex modulus as it approaches an outer layer. For example if the core's center has a complex modulus Es1 and the core's outermost layer has a complex modulus Esn then a ratio (Es1/Esn) falls within a range of 0.18 to 0.90, preferably 0.18 to 0.30;

(2) Form the cover of a highly resilient material and structure it to be relatively thick. For example provide a complex modulus of 140 MPa to 400 MPa, preferably 250 MPa to 400 MPa. Provide the cover with a thickness of 0.8 mm to 3.8 mm, preferably 1.5 mm to 3.8 mm; and (3) Provide a specific gravity largest at the center and gradually decreasing outwards and smallest at the ball surface. For example provide the solid core's center with a specific gravity adjusted to fall within a range of 1.18 to 1.3 and the cover within a range of 0.96 to 1.1.

The present invention in an embodiment will now be described more specifically with reference to the drawings.

Figure 5:
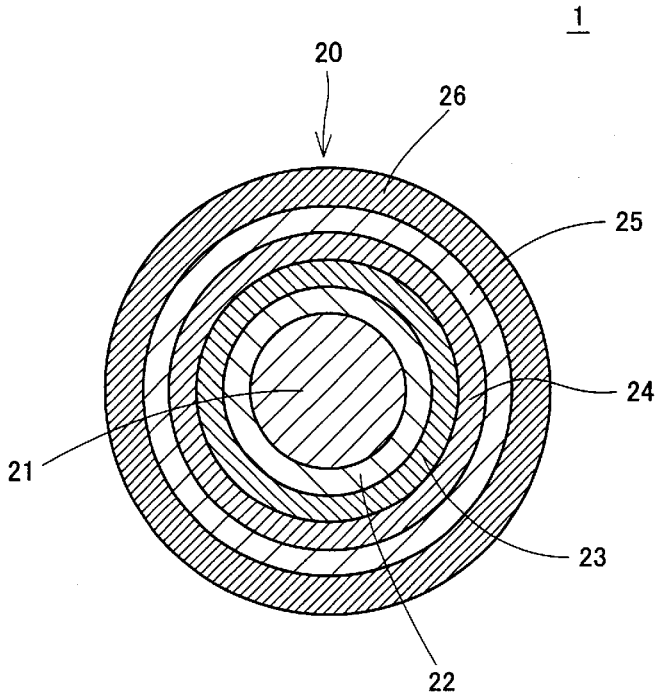
FIG. 5 is a cross section of a golf ball of the present invention.

FIG. 5 is a cross section of a golf ball of one embodiment of the present invention. In the figure a golf ball 20 includes a cover 26 and a solid core structured by a core center or first core layer 21, an outer, second core layer 22, a further outer, third core layer 23, a fourth core layer 24 and a fifth core layer 25 for a total of five layers. Conventionally a solid core is typically formed of one or two layers and seldom formed of three or more layers. In the present invention a solid core can be formed of more layers to help to adjust the aforementioned, primary natural frequencies fc and fn of the golf ball in value. If the FIG. 5 solid core has the core center (the first core layer) 21 to the fifth core layer 25 having their respective complex moduli Es1, Es2, Es3, Es4 and Es5, the complex moduli preferably satisfy the following relationship:

$$Es1<Es2<Es3<Es4<Es5.$$

The core center (the first core layer) 21 to the fifth core layer 25 having their respective complex moduli gradually increased allow ratio (fc/fn) to be set in a predetermined range. Note that solid core is formed of three or more layers, preferably four to seven layers, although the present solid core is not limited to any plurality of layers.

Furthermore the solid core can have each layer varying in specific gravity. For example the core center can have a specific gravity and the successive outer layers can have successively smaller specific gravities to adjust ratio (fc/fn). In this example the core center preferably has a specific gravity of a range from 1.18 to 1.3.

In the present invention the solid core is not limited to a solid core and it can alternatively be a thread-wound core, for example a liquid or solid inner core with rubber thread wound therearound. The present solid core or inner core used for the present thread-wound core is formed of a rubber composition crosslinked. The rubber composition contains a rubber component containing a base material suitably of butadiene rubber having a cis-1,4-strucuture, although the above butadiene rubber may be replaced for example by 40% by weight of natural rubber, styrene butadiene rubber, isoprene rubber, chloroprene rubber, butyl rubber, ethylene propylene rubber, ethylene propylene diene rubber, acrylonitrile rubber or the like blended for 100 parts by weight of the rubber component.

The rubber composition is crosslinked or co-cured with an agent, for example acrylic acid, methacrylic acid or any other similar α,β-ethylenic unsaturated carboxylic acid and zinc oxide or any other similar metal oxide that react during the preparation of the rubber composition and provide a metallic salt of α,β-ethylenic unsaturated carboxylic acid, or zinc acrylate, zinc methacrylate or any other similar metallic salt of α,β-ethylenic unsaturated carboxylic acid, polyfunctional polymer, N,N'-phenylbismaleimide, sulfur or any other similar substance typically used as a cross linker. In particular, zinc salt of α,β-ethylenic unsaturated carboxylic acid is preferable.

If a metallic salt of α,β-ethylenic unsaturated carboxylic acid is used as a cross linker or a co-curing agent, 10 to 40 parts by weight thereof is blended for 100 parts by weight of the rubber component. If α,β-ethylenic unsaturated carboxylic acid and a metal oxide react during the preparation of the rubber composition, 15 to 30 parts by weight of α,β-ethylenic unsaturated carboxylic acid and 15 to 35 parts by weight of zinc oxide or any other similar metal oxide for 100 parts by weight of the α,β-ethylenic unsaturated carboxylic acid can be blended together.

For the rubber composition, a filler can be used, such as one or more of barium sulfate, calcium carbonate, clay, zinc oxide or any other similar, inorganic powder. 5 to 50 parts by weight of such filler is preferably blended for 100 parts by weight of the rubber component.

Furthermore for example to enhance workability and adjust hardness, a softener, liquid rubber, or the like may be blended, as appropriate, and anti-oxidant may also be blended, as appropriate.

Furthermore, cross-linking is started by a cross-link initiator such as dicumylperoxide, 1,1-bis(t-butylperoxy) 3,3,5-trymethylcyclohexane, or any other similar, organic peroxide. 0.1 to 5 parts by weight, preferably 0.3 to 3 parts by weight of such a crosslink initiator is blended for 100 parts by weight of the rubber composition.

To produce the present solid core, a roll, a kneader, a Bunbury mixer and the like are used to mix materials and a rubber composition is thus prepared. The rubber composition is then introduced into a mold having top an bottom portions each having a semispherical cavity and it is then pressurized for example at 145° C. to 200° C., preferably 150° C. to 175° C. for 10 to 40 minutes and thus vulcanized to prepare a core center.

A chaplet having an outer diameter equal to the core center is then arranged in a mold with spherical cavity larger than an inner diameter of the core center and a rubber composition for the second core layer is introduced therein and heated at a predetermined temperature for a predetermined period of time to produce a semi-crosslinked half shell. The mold is opened and the chaplet is removed and the half shell for the second layer is obtained. The core center has upper and lower portions each covered with the half shell for the second layer and it is placed in a mold and thus further vulcanized to integrate the core center and the second core layer. This series of operations is repeated to provide a multi-layer solid core.

To allow the thus-produced solid core to have its outermost layer in good contact with the cover the outermost layer may have a surface with adhesive applied thereto or it may have a surface roughened.

The solid core and the thread-wound core have a designed diameter of 36.8 to 41.4 mm, preferably 37.8 to 40.8 mm. If they have a diameter less than 36.8 mm the cover layer would be increased in thickness and decrease in resilience. If they have a diameter exceeding 41.4 mm the cover layer would be reduced in thickness and thus difficult to mold.

The present invention provides a cover formed of a highly resilient material and structured to be relatively thick, for example with a complex modulus of 140 MPa to 400 MPa, preferably 250 MPa to 400 MPa, and a thickness of 0.8 mm to 3.8 mm, preferably 1.5 mm to 3.8 mm. Furthermore the cover can be formed of a single layer or a plurality of layers and if it is formed of a plurality of layers it is preferably formed of material to provide a modulus of elasticity greater at the outer layer(s). Preferably the cover is smaller in specific gravity than the solid core. For example the core center has a specific gravity adjusted in a range of 1.18 to 1.3 and the cover has that adjusted in a range of 0.96 to 1.1. Preferably the cover has a complex modulus greater in value than that of the core center of the multi-layer solid core, any layer of the solid core in particular.

The cover contains thermoplastic resin, e.g., ionomer resin, polyethylene, polypropylene, polystyrene, ASB resin, methacryl resin, polyethyleneterephthalate, ACS resin, polyamide or any other similar, general-purpose resin, although it preferably contains ionomer resin. Thermoplastic elastomer can also be used.

The ionomer resin is typically a copolymer of α-olefin and α,β-unsaturated carboxylic acid of a carbon number of 3 to 8 with a carboxyl group thereof at least partially neutralized with a metallic ion to provide a dual-copolymer. It may alternatively be a terpolymer of α-olefin, α,β-unsaturated carboxylic acid of a carbon number of 3 to 8 and α,β-unsaturated carboxylate of a carbon number of 2 to 22 with a carboxyl group thereof at least partially neutralized with a metallic ion.

If the ionomer resin has a composition containing a base polymer of α-olefin and α,β-unsaturated carboxylic acid of carbon number of 3 to 8 to provide a bipolymer, it preferably contains 80 to 90% by weight of α-olefin and 10 to 20% by weight of α,β-unsaturated carboxylic acid. If the base polymer is the terpolymer of α-olefin, α,β-unsaturated carboxylic acid of a carbon number of 3 to 8 and α,β-unsaturated carboxylate of a carbon number of 2 to 22 it preferably contains 70 to 85% by weight of α-olefin, 5 to 30% by weight, preferably 12 to 20% by weight of α,β-unsaturated carboxylic acid and 10 to 25% by weight of α,β-unsaturated carboxylate. These ionomer resins preferably have a melt index (MI) of 0.1 to 20, preferably 0.5 to 15. Carboxylic acid or carboxylate contained in the above range can enhance resilience.

The α-olefin is for example ethylene, propylene, 1-butene, 1-pentene or the like and preferably it is ethylene. α,β-unsaturated carboxylic acid of a carbon number of 3 to 8 is for example acrylic acid, methacrylic acid, fumaric acid, maleic acid or crotonic acid and preferably it is acrylic acid or methacrylic acid. Unsaturated carboxylate is for example methyl, ethyl, propyl, n-butyl or isobutyl, ester for example of acrylic acid, methacrylic acid, fumaric acid or maleic acid and preferably it is acrylic ester or methacrylic ester.

The copolymer of α-olefin and α,β-unsaturated carboxylic acid or the terpolymer of α-olefin, α,β-unsaturated carboxylic acid and α,β-unsaturated carboxylate has a carboxyl group at least partially neutralized with a metallic ion such as sodium ion, lithium ion, zinc ion, magnesium ion or potassium ion.

The above ionomer resin specifically exemplified under trade name includes an ionomer of a bipolymer commercially available from Mitsui-DuPont Polychemical Co., Ltd. such as Hi-milan 1555 (Na), Hi-milan 1557 (Zn), Hi-milan 1605 (Na), Hi-milan 1706 (Zn), Hi-milan 1707 (Na), Hi-milan AM 7318 (Na), Hi-milan AM 7315 (Zn), Hi-milan AM 7317 (Zn), Hi-milan AM 7311 (Mg), Hi-milan MK 7320 (K) and the like, and an ionomer resin of a terpolymer such as Hi-milan 1856 (Na), Hi-milan 1855 (Zn), Hi-milan AM 7316 (Zn) and the like.

Furthermore, DuPont Co., Ltd. commercially provides ionomer resin under the trade names of Surlyn 8940 (Na), Surlyn 8945 (Na), Surlyn 9910 (Zn), Surlyn 9945 (Zn), Surlyn 7930 (Li), Surlyn 7940 (Li) and the like, and the terpolymer-type ionomer resin such as Surlyn AD 8265 (Na), Surlyn AD 8269 and the like.

Furthermore, Exxon Chemical Japan Ltd. commercially provides the ionomer resin under the trade names of Iotek 7010 (Zn), Iotek 8000 (Na), and the like. Note that the above trade names of ionomer resin are followed by parenthesized symbols Na, Zn, K, Li, Mg and the like, which indicate metal types of these neutralizer metallic ions. Furthermore in the present invention the ionomer resin used for the cover composition may be a mixture of two or more of the above exemplified ionomer resins or a mixture of one or more of the above exemplified, monovalent metallic ion neutralized, ionomer resins and one or more of the above exemplified, divalent metallic ion neutralized, ionomer resins.

The thermoplastic elastomer includes styrene-type thermoplastic elastomer, urethane-type thermoplastic elastomer, ester-type thermoplastic elastomer, olefin-type thermoplastic elastomer, amide-type thermoplastic elastomer and the like.

The styrene-type thermoplastic elastomer is a block copolymer having a molecule with soft and hard segments therein. The soft segment is a unit for example of a butadiene block, an isoprene block or the like obtained from a conjugated diene compound which can be one or more selected for example from butadiene, isoprene, 1,3-pentadiene, 2,3-dimethyl-1,3-butadiene and the like, preferably butadiene, isoprene and a combination thereof. The hard segment is constituted by a unit for example of a styrene block obtained from a compound with one or more selected for example from styrene and a derivative thereof, e.g., α-methylstyrene, vinyl toluene, p-third butylstyrene, 1,1-diphenylethylene and the like. In particular, styrene block unit is suitable.

More specifically the styrene-type thermoplastic elastomer for example includes a styrene-isoprene-butadiene-styrene block copolymer (an SIBS structure), a styrene-butadiene-styrene block copolymer (an SBS structure), the SBS structure having butadiene with a double bond hydrogenated, or a styrene-ethylene-butylene-styrene block copolymer (an SEBS structure), a styrene-isoprene-styrene block copolymer (an SIS structure), the SIS structure having isoprene with a double bond hydrogenated, or a styrene-ethylene-propylene-styrene block copolymer (an SEPS structure), a styrene-ethylene-ethylene-propylene-styrene copolymer (an SEEPS structure), and these copolymers modified.

Note that the above SIBS, SBS, SEBS, SIS, SEPS and SEEPS structures contain 10 to 50% by weight, in particular 15 to 45% by weight of styrene (or a derivative thereof). If the copolymers contain less than 10% by weight of styrene the cover would be too soft and cut-resistance would tend to reduce and value (fc/fn) would be difficult to adjust.

In the present invention the SIBS, SBS, SEBS, SIS, SEPS and SEEPS structure copolymers may partially be a modification provided via a functional group selected from the group of an epoxy group, a hydroxy group, an acid anhydride, and a carboxyl group.

The present cover composition can contain the aforementioned thermoplastic resin and thermoplastic elastomer as a polymer component, independently or mixed together. If they are mixed, no more than 50% by weight of the thermoplastic elastomer is preferably mixed for 100 parts by weight of the polymer component to obtain a high complex modulus.

Mixing ionomer resin or any other similar thermoplastic resin and thermoplastic elastomer together can provide the cover composition with an appropriate level of elasticity and achieve a satisfactory hit feel. Furthermore in the present invention a short organic fiber, such as, nylon fiber, acrylic fiber, polyester fiber, aramid fiber or the like can be blended to increase the cover's complex modulus.

EXAMPLES

Examples 1–4 and Comparative Examples 1–3

(1) Production of Solid Core

In accordance with blendings A to F shown in Table 2, materials were mixed together by means of a roll, a kneader, a Bunbury mixer and the like and a rubber composition was thus prepared. The rubber composition was then introduced into a mold having top an bottom portions each having a semispherical cavity and it was then pressurized at 160° C. for 20 minutes and thus vulcanized to produce a core center.

TABLE 2

| composition[1)] | A | B | C | D | E | F | G | H | I | J | K |
|---|---|---|---|---|---|---|---|---|---|---|---|
| polybutadiene[2)] | 100 | 100 | 100 | 100 | 100 | 100 | 100 | 100 | 100 | 100 | 100 |
| zinc acrylate[3)] | 30.0 | 28.0 | 27.0 | 26.5 | 25.0 | 23.0 | 22.3 | 20.5 | 19.0 | 8.0 | 15.3 |
| zinc oxide[4)] | 19.5 | 20.0 | 20.5 | 20.8 | 21.3 | 22.0 | 22.2 | 23.0 | 23.4 | 27.5 | 24.7 |
| dicumylperoxide | 1.0 | 1.0 | 1.0 | 1.0 | 1.0 | 1.0 | 1.0 | 1.0 | 1.0 | 1.0 | 1.0 |
| complex modulus (MPa) | 153 | 135 | 127 | 120 | 112 | 90 | 76 | 61 | 51 | 40 | 35 |

Note:
[1)]Materials blended are represented in parts by weight.
[2)]available from JSR Corporation under the product name of BR01
[3)]available from NIHON SHOKUBAI CO., LTD.
[4)]available from TOHO ZINC CO., LTD.

A chaplet having an outer diameter equal to the core center was then arranged in a mold with the semispherical cavity larger than an inner diameter of the core center and a predetermined rubber composition was introduced therein and pressurized at 160° C. for 20 minutes to produce a semi-crosslinked half shell. The mold was opened and the chaplet was removed and the half shell for the second layer was obtained. The core center had upper and lower portions each covered with the half shell for the second layer and it was placed in a mold and thus further vulcanized to integrate the core center and the second core layer. This series of operations was repeated to provide a solid core formed of the core center or first layer through the fifth layer. The composition, a complex modulus and a thickness, of each layer are shown in Table 4.

(2) Preparation of Composition for Cover

A composition for a cover, as presented in Table 3, was mixed by means of a dual-axis, kneader and extruder and it was extruded by a twin-screw extruder at a cylinder temperature of 180° C. applied. In extruding the composition, the screw had a diameter of 45 mm, a rotation rate of 200 rpm and an L/D of 35.

TABLE 3

| composition | parts by weight |
|---|---|
| Hi-milan 1605[1)] | 50 |
| Hi-milan 1706[2)] | 50 |
| titanium oxide | 2 |
| barium sulfate | 2 |

Note:
[1)]Na ion neutralized ethylene/methacrylic acid copolymer type ionomer resin of Mitsui-DuPont Polychemical Co., Ltd.
[2)]Zn ion neutralized ethylene/methacrylic acid copolymer type ionomer resin of Mitsui-DuPont Polychemical Co., Ltd.

The composition for the cover was used to injection-mold a semispherical, half shell and two such half shells were used to cover the above obtained core. It was then placed in a mold and at 150° C. pressed, thermally compressed and molded. After it was cooled the golf ball was removed from the mold and then had a surface painted and a golf ball of 42.8 mm in diameter and 45.4 g in weight was thus produced.

The golf ball thus produced had its physical properties and ball performance estimated, as described below:

(1) Complex Modulus

A viscoelasticity spectrometer of Rheology Research Center was used to measure a complex modulus in a compression mode. In measuring the complex modulus, an initial strain of 0.4 mm, a displacement amplitude of ±1.5 μm, a frequency of 10 Hz, an end temperature of 110° C. and a programming rate of 4° C./min were applied, and it was calculated from a ratio in amplitude of a drive portion and a response portion at 20° C. and a phase difference thereof. A sample piece of a longitudinal dimension of 4 mm by a lateral dimension of 4 mm by a thickness of 2 mm can be used. If such a sample piece cannot be obtained from the golf ball, a sample formed of materials that are blended and vulcanized in the same manner as each core layer of the golf ball, may alternatively be used.

(2) Measurement of fc and fn

Figure 2:
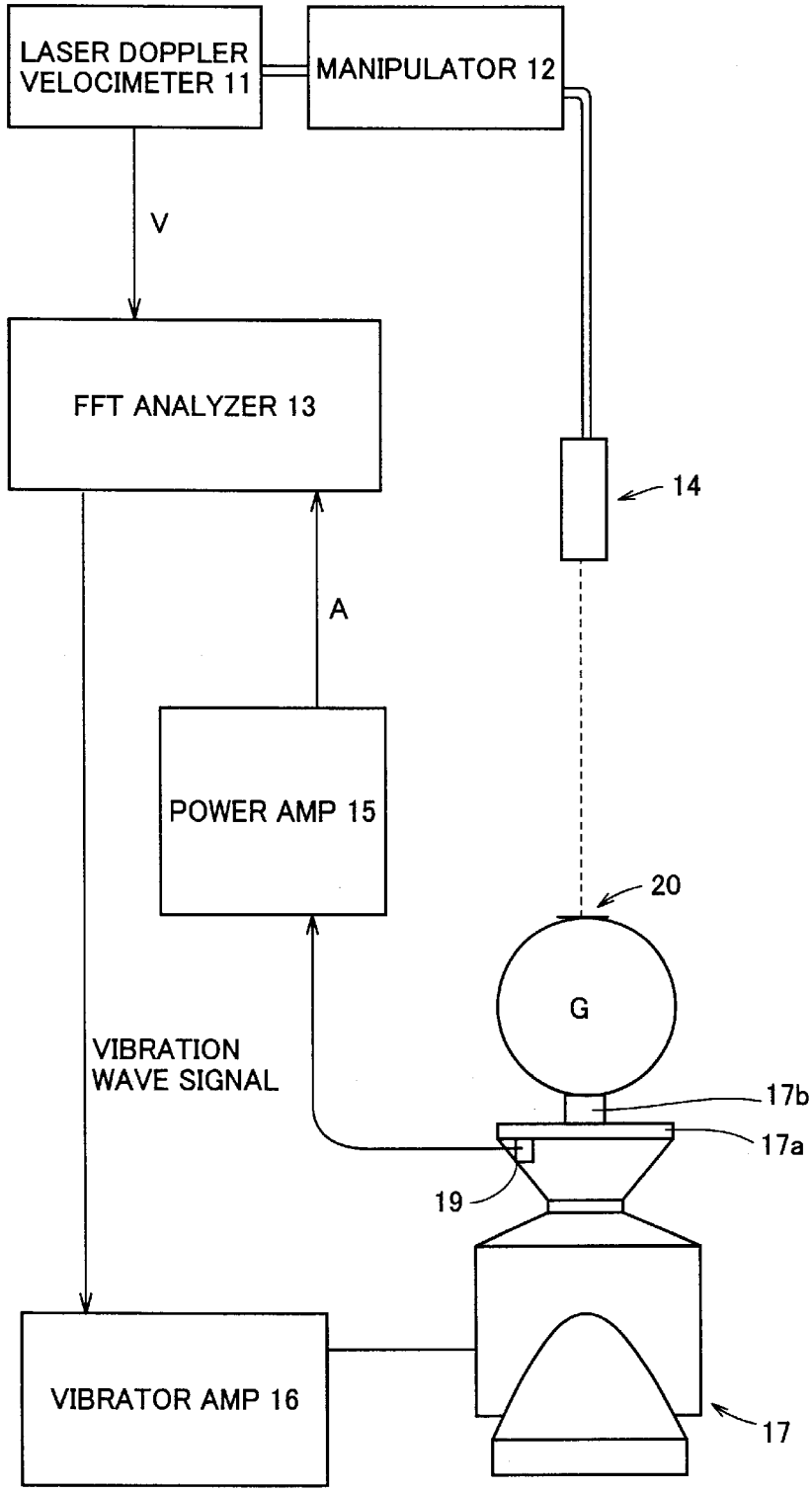
FIG. 2 schematically shows an apparatus employed to measure fn.
Figure 7:
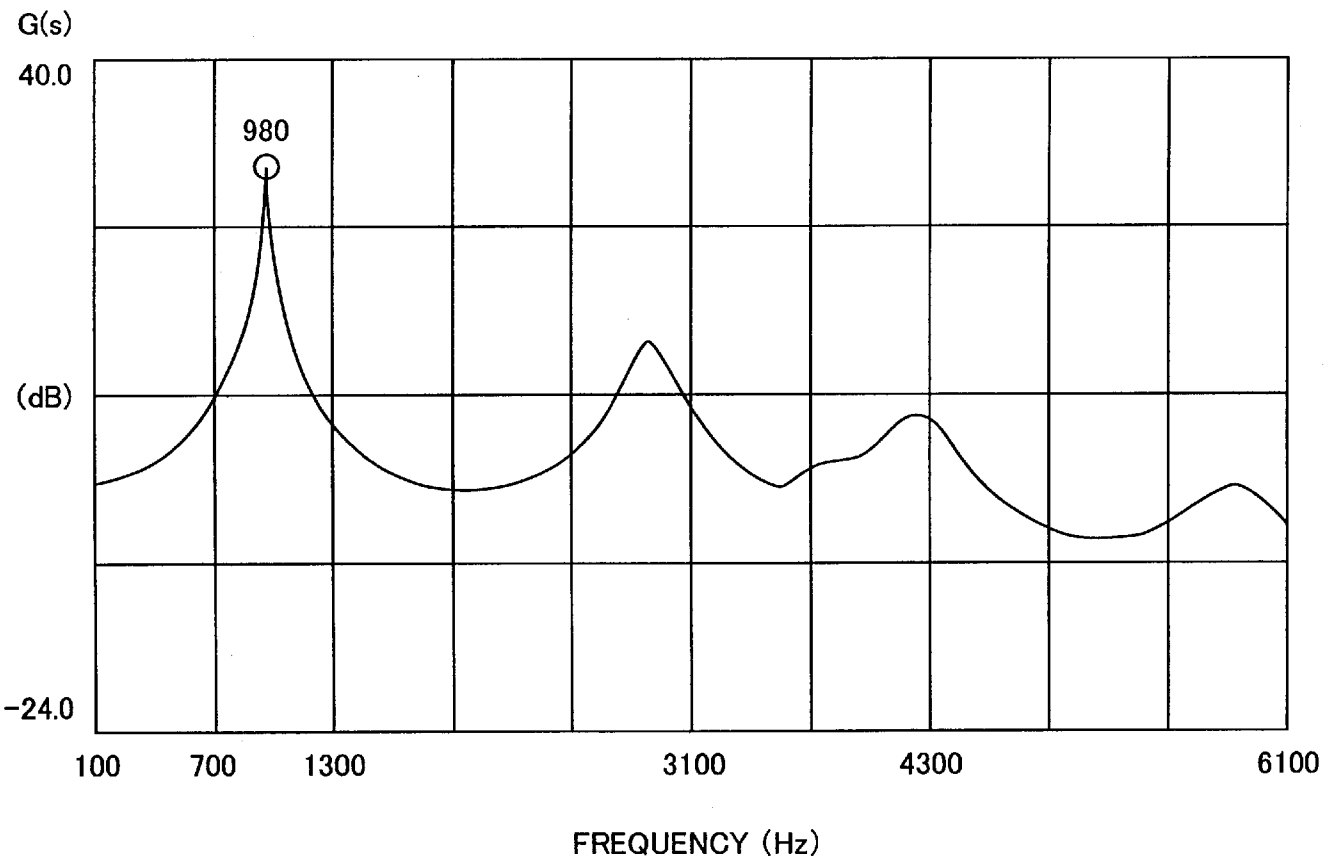
FIG. 7 is a chart of a measurement of fn of a first embodiment.
Figure 8:
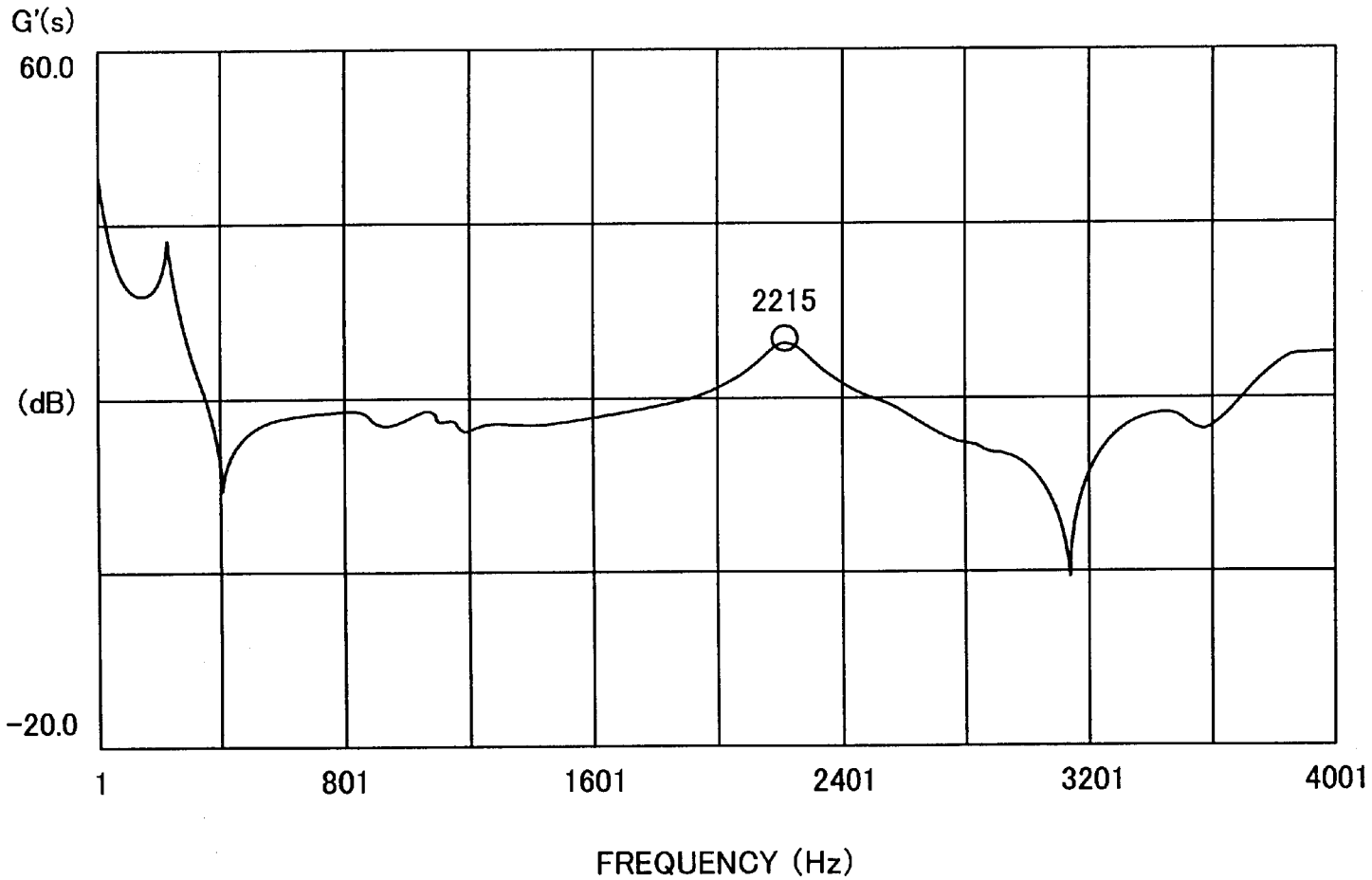
FIG. 8 is a chart of a measurement of fc of the first embodiment.

The above golf ball's primary natural frequency in a direction of longitudinal flexure (fn) was measured in the procedure shown in FIG. 2. Its primary natural frequency in a vibration mode in a direction of torsion (fc) was also measured in the procedure shown in FIG. 3. For examples 1–4 and comparative examples 1–3, fn, fc and (fc/fn) each had a value, as shown in Table 4. For example 1, fn was measured, as shown in the chart of FIG. 7. In the figure, the axis of abscissa represents frequency and the axis of ordinates represents frequency transfer function (G(s)). Herein a natural frequency fn of 980 hertz was provided. Furthermore, for example 1, fc was measured, as shown in the chart of FIG. 8. In the figure, the axis of abscissa represents frequency and the axis of ordinates represents frequency transfer function (G'(s)). Herein a natural frequency fc of 2,215 hertz was provided.

(3) Backspin Rate, Launch Angle, and Flight Distance 10 golf balls of each of the examples and comparative examples were prepared. A swing robot of True Temper Sports had a No. 4 iron (available form Sumitomo Rubber Industries, Ltd. under the product name of Hybrid AutoFocus) attached thereto and a head speed of 38.8 m/sec was set for the machine. The machine hit the golf balls and for each ball a backspin rate (rpm) immediately after it was hit, a launch angle and a flight distance (a distance from a point at which the ball was hit to a point at which the ball stopped) were measured. The 10 balls for each of the examples and comparative examples had an average value, as shown in Table 4.

TABLE 4

| | | comparative ex. 1 | comparative ex. 2 | comparative ex. 3 | example 1 | example 2 | example 3 | example 4 |
|---|---|---|---|---|---|---|---|---|
| core[1)] | 1st layer (composition/complex modulus (MPa)) | D/120 | D/120 | — | J/40 | J/40 | J/40 | k/35 |
| | 2nd layer (composition/complex modulus (MPa)) | E/112 | D/120 | — | H/61 | I/51 | I/51 | J/40 |
| | 3rd layer (compositon/complex modulus (MPa)) | E/112 | D/120 | — | G/76 | F/90 | I/51 | H/61 |
| | 4th layer (composition/complex modulus (MPa)) | F/90 | D/120 | — | D/120 | C/127 | H/61 | A/153 |
| | 5th layer (composition/complex modulus (MPa)) | H/61 | D/120 | — | B/135 | B/135 | B/135 | A/153 |
| cover (complex modulus[2)] (MPa)) | | 343 | 343 | — | 343 | 343 | 343 | 343 |
| $f_n$[3)] | | 980 | 990 | 978 | 980 | 960 | 970 | 991 |
| $f_c$[4)] | | 2009 | 2079 | 2142 | 2215 | 2189 | 2280 | 2398 |
| $f_c/f_n$) | | 2.05 | 2.10 | 2.19 | 2.26 | 2.28 | 2.35 | 2.42 |
| backspin rate (rpm) | | 3992 | 3943 | 3881 | 3859 | 3841 | 3835 | 3863 |
| launch angle (degree) | | 14.1 | 14.3 | 14.3 | 14.5 | 15.1 | 15.2 | 14.4 |
| flight distance (m) | | 173.1 | 173.4 | 174.1 | 175.1 | 176.4 | 176.9 | 174.3 |

Figure 6:
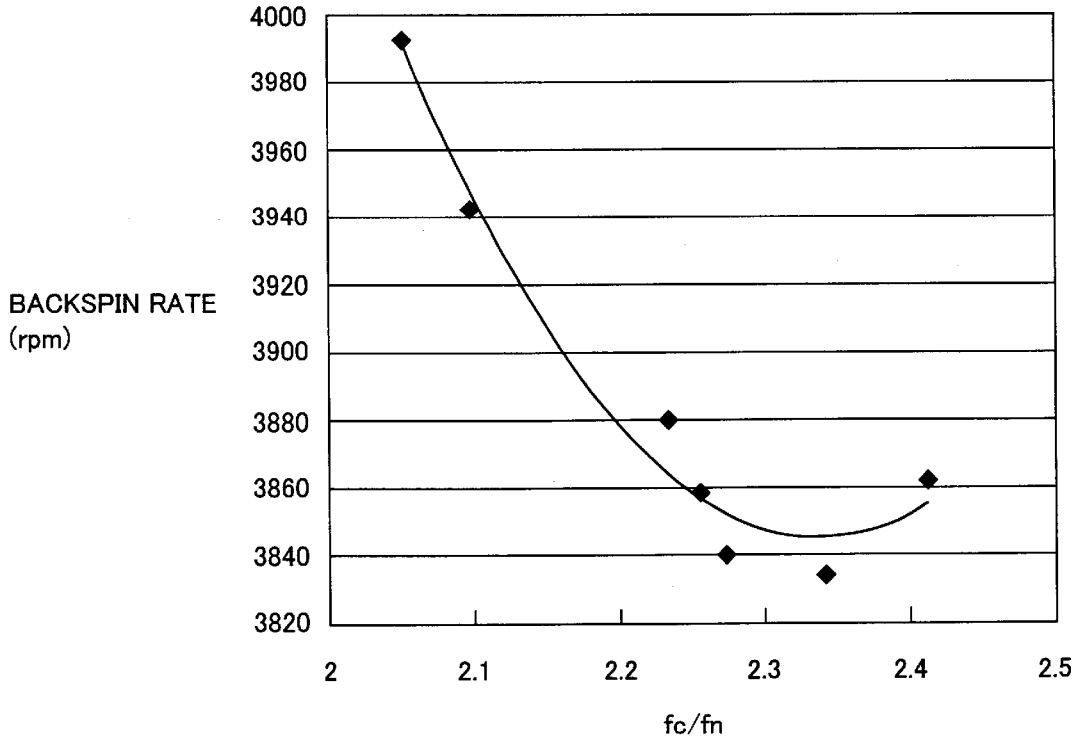
FIG. 6 is a graph of backspin rate versus (fc/fn)

Note:
[1)]The 1st layer is 7.68 mm and the 2nd to 5th layers are 3.84 mm in diameter.
[2)]cover thickness: 2.20 mm
[3)]fn: primary natural frequency in a direction of longitudinal flexure
[4)]fc: primary natural frequency in a vibration mode in a direction of torsion FIG. 6 represents a relationship between value (fc/fn) and backspin rate, as measured, for the examples and comparative examples. For a (fc/fn) in a range of 2.22 to 2.45 a backspin rate of no more than 3,880 rpm was provided and it can thus be seen that a low spin rate has been achieved. Furthermore it can be understood that examples 1–4, with a (fc/fn) in the range of 2.22 to 2.45, are also found from Table 4 to be superior to comparative examples 1–3 in launch angle and flight distance.

As has been described above, the present invention can provide a ratio of a primary natural frequency provided in a direction in which a golf ball deforms (in a longitudinal direction) (fn) and a primary natural frequency in a vibration mode in a direction of torsion (fc), i.e., a ratio (fc/fn) of a relatively large value ranging from 2.22 to 2.45 to provide the ball with a low backspin rate and a large launch angle and an increased flight distance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball, comprising at least three layers having a solid core and a cover, said cover having a complex modulus of from 140 MPa to 400 MPa, wherein said golf ball provides a ratio of a primary natural frequency of the golf ball in a direction in which the ball deforms (in a longitudinal direction) (fn) and a primary natural frequency of the ball in a vibration mode in a direction of torsion (fc), i.e., a ratio (fc/fn) in a range:

$$2.22 \leqq (fc/fn) \leqq 2.45 \text{ and}$$

wherein both the values of (fc) and (fn) are between 400 and 4000 Hz.

2. A golf ball comprising a solid core and a cover, said solid core being formed of a plurality of layers and having a center smaller in complex modulus than an outermost layer of said core, and wherein said golf ball has a center smaller in complex modulus than said cover, and wherein said cover is greater in complex modulus than the core adjacent thereto, wherein said cover has a complex modulus that is from 140 MPa to 400 MPa and wherein (fc) and (fn) are from 400 to 4000 Hz, and wherein (fn) is a primary natural frequency of the ball in a direction in which the ball deforms, and (fc) is a primary natural frequency of the ball in a vibration mode in a direction of torsion.

3. The golf ball of claim 1 or 2, wherein (fc/fn) is no smaller than 2.26 and no greater than 2.42.

4. The golf ball of claim 1 or 2, wherein (fc/fn) is no smaller than 2.28 and no greater than 2.35.

5. The golf ball of claim 1 or 2 comprising a solid core and a cover, said solid core being formed of a plurality of layers and having a center smaller in complex modulus than said cover.

* * * * *